US007426979B2

(12) United States Patent
Nagai

(10) Patent No.: US 7,426,979 B2
(45) Date of Patent: Sep. 23, 2008

(54) EXHAUST GAS CONTROL VALVE

(75) Inventor: Tadashi Nagai, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 301 days.

(21) Appl. No.: 11/327,431

(22) Filed: Jan. 9, 2006

(65) Prior Publication Data

US 2006/0150620 A1 Jul. 13, 2006

(30) Foreign Application Priority Data

Jan. 12, 2005 (JP) ..... 2005-005700

(51) Int. Cl.

| | |
|---|---|
| ***F16K 17/02*** | (2006.01) |
| ***F16K 17/04*** | (2006.01) |
| *F01N 1/16* | (2006.01) |
| *F16K 15/02* | (2006.01) |
| *F16K 21/04* | (2006.01) |

(52) U.S. Cl. ..... 181/237; 181/254; 137/527.6; 137/527.4

(58) Field of Classification Search ..... 181/237, 181/236, 254; 137/527.6, 527, 527.4, 15.18, 137/15.17

See application file for complete search history.

(56) References Cited

U.S. PATENT DOCUMENTS

| | | | | |
|---|---|---|---|---|
| 5,801,343 | A * | 9/1998 | Suzuki et al. | 181/254 |
| 5,984,045 | A * | 11/1999 | Maeda et al. | 181/254 |
| 6,176,347 | B1 * | 1/2001 | Chae et al. | 181/254 |
| 6,581,721 | B2 * | 6/2003 | Nagai et al. | 181/237 |
| 6,637,449 | B2 * | 10/2003 | Nagai et al. | 137/15.18 |
| 6,732,511 | B2 * | 5/2004 | Unbehaun et al. | 60/324 |
| 6,736,160 | B2 * | 5/2004 | Nagai et al. | 137/527.6 |

FOREIGN PATENT DOCUMENTS

| | | | |
|---|---|---|---|
| JP | 2002-235536 | A | 8/2002 |
| JP | 2004-162650 | A | 6/2004 |
| JP | 2005207382 | A * | 8/2005 |

* cited by examiner

*Primary Examiner*—Edgardo San Martin
(74) *Attorney, Agent, or Firm*—Foley & Lardner LLP

(57) ABSTRACT

An exhaust gas control valve includes a valve seat, a valve plate having a first exhaust gas pressure receiving area corresponding to an opening area and a second exhaust gas pressure receiving area larger than the first area; and a spring for closing the valve. In a closed state, gas pressure during a low engine speed operation acts on only the first exhaust area for shutting the opening. In an intermediate state, the pressure during a the middle engine speed operation acts on the first and second areas for opening the opening but closing the valve by overlap of wall portions of the valve plate and the valve seat overlap. In an opening state, the pressure during a high engine speed operation acts on the first and second areas for forming a gap between the wall portions to pass the gas therethrough.

13 Claims, 9 Drawing Sheets

EXHAUST GAS CONTROL VALVE

BACKGROUND OF THE INVENTION

1. Field of the Invention

The present invention relates to an exhaust gas control valve used for an exhaust muffler of a motor vehicle or the like.

2. Description of the Related Art

An exhaust gas control valve is ordinarily arranged in an exhaust muffler on an opening edge portion of an exhaust pipe or on a communicating hole portion of a partition plate, such as a baffle plate, of the muffler so as to suppress fall in engine output power due to exhaust gas pressure loss. The control valve opens and closes according to exhaust gas pressure so that it increases the effect on attenuation of exhaust noise by shifting exhaust gas passages connectable with plural small chambers defined in the inside of the muffler in an optimum combination of the chambers according to exhaust gas pressure fluctuation.

A conventional exhaust gas control valve of this kind is disclosed in Japanese patent laying-open publication No. 2002-235536. This conventional valve has a valve seat provided on an opening edge portion of an exhaust pipe arranged in a muffler main body, a valve plate rotatable around a shaft fixed on a projecting portion of the valve seat and contactable with an annular seat surface of the valve seat for closing the valve, and a coil spring for urging the valve plate toward its closed position.

The control valve is closed by spring force of the coil spring during low engine speed operation, where exhaust gas pressure is lower than the spring force. This closing of the control valve provides the muffler with plural small chambers so that one of the small chambers acts as a resonant chamber for decreasing exhaust noise prior to prevention against fall of engine output power. During high engine speed operation, the control valve is opened by high exhaust gas pressure stronger than the spring force of the spring, shifting its exhaust gas passages to form an enlarged chamber by connecting the small chambers for suppressing the fall of the engine output power prior to the exhaust noise reduction.

This conventional exhaust gas control valve, however, encounters the following problems. The spring force generated by the coil spring becomes larger with an opening amount of the valve, urging the valve plate strongly toward the valve seat during the high engine speed operation. Consequently, the valve is held down in its opening amount during the high engine speed operation, not discharging the exhaust gas in the muffler into the air sufficiently. This causes back pressure in the muffler to rise, lessening the engine output power.

On the other hand, the spring may be set to have spring force lower, urging the valve plate toward the valve seat weakly in order to decrease the back pressure during the high engine speed operation. Consequently, the valve is easily opened in relatively low engine speed operation and its opening amount becomes larger than expected. This premature opening of the valve provides the expanded chamber in the muffler by shifting its exhaust gas passages, causing insufficient reduction in the exhaust gas noise during the low engine speed operation.

That is, the conventional control valve has a trade-off relationship between the exhaust gas noise reduction during the low engine speed operation and the back pressure reduction during the high engine speed operation, not obtaining them at the same time.

It is, therefore, an object of the present invention to provide an exhaust gas control valve which overcomes the foregoing drawbacks and can decrease exhaust gas noise in a low engine speed operation and back pressure in a muffler in a high engine speed operation at the same time.

SUMMARY OF THE INVENTION

According to an aspect of the present invention there is provided an exhaust gas control valve which shifts exhaust gas passages connectable between plural rooms in a muffler according to engine speed, where the exhaust gas control valve includes a valve seat, a valve plate and a spring. The valve seat is formed with a valve seat surface and provided with a wall portion projecting from the valve seat surface, and the valve seat has an opening to pass exhaust gas through the valve seat. The valve plate is formed with a valve plate surface and provided with a wall portion arranged along the wall portion of the valve seat, where the valve plate surface has a first exhaust gas pressure receiving area which corresponds to an area of the opening and is contactable with the seat surface so that the exhaust gas control valve can prevent leakage of the exhaust gas through the opening and a second exhaust gas pressure receiving area which is larger than the first exhaust gas pressure receiving area. The spring presses the valve plate toward the valve seat. The exhaust valve is shiftable among at least a closed state where pressure of the exhaust gas generated in a low engine speed operation acts on only the first exhaust gas pressure receiving area and the first exhaust gas pressure receiving area is in contact with the valve seat surface to shut the opening, an intermediate state where the pressure generated in a middle engine speed operation acts on the first exhaust gas pressure receiving area and the second exhaust gas pressure receiving area and the valve elate surface is apart from the valve seat surface to open the opening while the wall portions of the valve plate and the valve seat overlap with each other to keep the exhaust gas control valve being closed, and an opening state where the pressure generated in a high engine speed operation acts on the first exhaust gas pressure receiving area and the second exhaust gas pressure receiving area and at least a part of the wall portions are apart from each other to form a gap through which the exhaust gas can pass. The valve seat has a seat body portion having the valve seat surface, a tip wall portion projecting from a tip end of the seat body portion, and side wall portions projecting from side edges of the seat body portion and bridging both ends of the tip wall portion, and wherein the valve plate has a valve body portion having the valve plate surface, a tip portion and side wall portions which are arranged along the tip portion and the side wall portions of the valve seat and insertable within an area surrounded by the tip portion and the side wall portions of the valve seat. The valve plate is rotatable around a shaft relative to the valve seat, and wherein a shaft side portion of the seat body portion and a shaft side portion of the valve body portion have guide portions with circular-arc shaped inner surfaces centered on the shaft and facing with each other for preventing a leakage of the exhaust gas therebetween.

Therefore, the control valve can decrease exhaust gas noise in the low engine speed operation and back pressure in the muffler in the high engine speed operation at the same time. The control valve can be constructed easily to decrease exhaust gas noise in the low engine speed operation and back pressure in the muffler in the high engine speed operation at the same time. The guide portion can prevent a leakage of the exhaust gas from a gap between them in the closed state and in the opening state, providing sufficient reduction in the back pressure for suppressing fall of the engine output power by enlargement of the exhaust gas pressure receiving area of the valve plate during the high engine speed operation. spring.

Preferably, the shaft is located over the guide portions and supports the spring.

Therefore, the spring is not exposed to the hot exhaust gas directly outputted from the gap between the guide portions, which can enhance permanent set-in fatigue resistance of the spring.

Preferably, the valve seat surface and the valve plate surface are formed in a flat rectangular shape.

Therefore, the valve seat surface and the valve plate surface can be formed easily and at low manufacturing cost.

Preferably, the exhaust gas control valve is fixed to one of a pipe and a baffle plate of the muffler so that the exhaust gas control valve can prevent and allow a flow of the exhaust gas therethrough.

Therefore, the control valve can be easily disposed despite of a figuration or construction of the muffler.

Preferably, the valve plate surface has more than one exhaust gas pressure receiving areas which become larger in area as the valve plate moves further away from the valve seat in the intermediate state.

Therefore, the exhaust gas pressure receiving areas can shifted to increase its area gradually through multi stages before it opens, which can suppress unstable fluctuation of gas pressure due to sudden enlargement of the exhaust gas pressure receiving area.

Preferably, the valve plate is rotatable around a shaft relative to the valve seat, and wherein the valve seat has seat body portions in a stepped shape which project in turn in a direction opposite to the shaft and higher in turn in a direction apart from the opening, and the valve has a valve body portions in a stepped shape fittable to the seat body portions.

Therefore, the control valve having the seat body portions and the valve body portions in a stepped shape for suppressing the unstable fluctuation of the gas pressure due to the sudden enlargement of the exhaust gas pressure receiving area.

BRIEF DESCRIPTION OF THE DRAWINGS

The objects, features and advantages of the present invention will become apparent as the description proceeds when taken in conjunction with the accompanying drawings, in which:

FIG. 2A shows the control valve in a closed state, FIG. 2B shows the control valve in an intermediate stage state, and FIG. 2C shows the control valve in an opened state;

FIG. 5A shows the control valve in a closed state, FIG. 5B shows the control valve in an intermediate stage state, FIG. 5C shows the control valve in a second-stage opened state, and FIG. 5D shows the control valve in an opened position;

FIG. 8A shows the control valve in a closed state, FIG. 8B shows the control valve in an intermediate stage state, and FIG. 8C shows the control valve in an opened state.

DETAILED DESCRIPTION OF THE PREFERRED EMBODIMENTS

Figure 1:
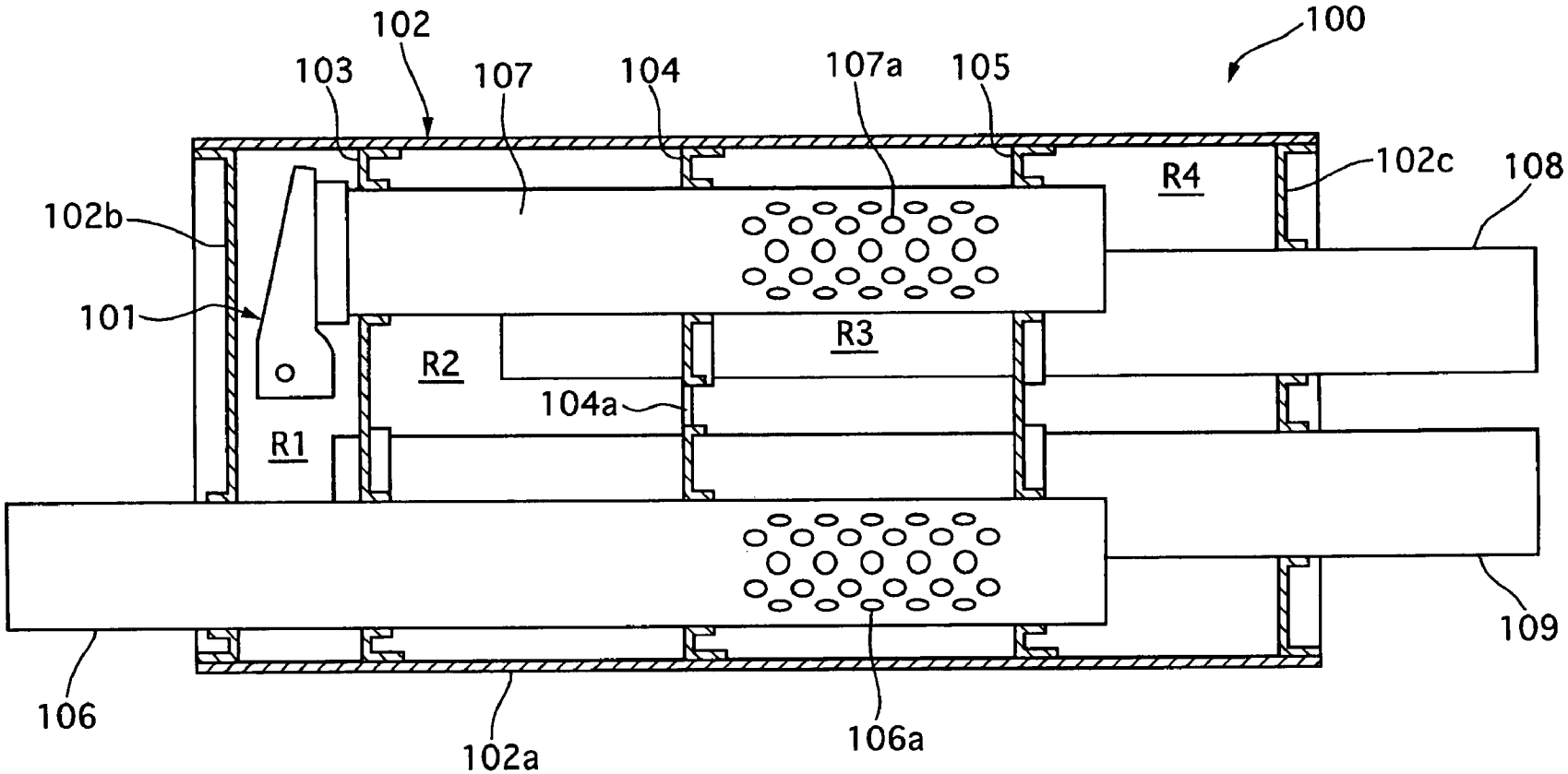
FIG. 1 is a cross-sectional side view of a muffler with an exhaust gas control valve of a first embodiment according to the present invention.

Throughout the following detailed description, similar reference characters and numbers refer to similar elements in all figures of the drawings, and their descriptions are omitted for eliminating duplication.

Referring to FIG. 1, there is shown a muffler 100, for an exhaust system of a motor vehicle, provided with an exhaust gas control valve 101 of a first embodiment according to the present invention.

The muffler 100 has a muffler main body 102, an inlet pipe 106 for introducing exhaust gas discharged from a not-shown engine into the inside of the muffler 100, a first outlet pipe 108 and a second outlet pipe 109 for discharging the gas into the air, and a communicating pipe 107 provided with the exhaust gas control valve 101 at its one end portion.

The muffler main body 102 has a casing 102*a*, an inlet-side wall 102*b*, an outlet-side wall 102*c*, a first partition wall 103, a second partition wall 104 and a third partition wall 105. The casing 102*a* is shaped in a tube with an elliptic cross-section and closed by the inlet-side wall 102*b* and the outlet-side wall 102*c* respectively at its both opening end portions. The inside of the casing 102*a* is defined by the first to third partition walls 103, 104 and 105 with the inlet-side and outlet-side walls 102*b* and 102*c* to form a first chamber R1, a second chamber R2, a third chamber R3 and a fourth chamber R4 inside the casing 102*a*. The second partition wall 104 is formed at its central portion with a communicating hole 104*a*, which is smaller in the cross-sectional area than the pipes 106, 107, 108 and 109 and always communicates the second chamber R2 and the third chamber R3. These walls 102*b*, 102*c*, and 103 to 105 are welded at their outer peripheral portions to an inner surface of the casing 102*a*.

The inlet pipe 106 is supported by the inlet-side wall 102*b* and first to third partition walls 103, 104 and 105, and formed with a plurality of holes 106*a* for passing the exhaust gas between the inside of the inlet pipe 106 and the third chamber R3, always fluidically connecting a not-shown exhaust port of the engine with the fourth chamber R4.

The first outlet pipe 108 is supported by the second to third partition walls 104 and 105 and the outlet-side wall 102*c*, and always fluidically communicates the second chamber R2 with outside of the muffler 100.

The second outlet pipe 109 is supported by the first to third partition walls 103 to 105 and the outlet-side wall 102*c*, and formed longer than the first outlet pipe 108, always fluidically communicating the first chamber R1 with the outside of the muffler 100.

The communicating pipe 107 is supported by the first to third partition walls 103 to 105, and formed with a plurality of holes 107*a* for passing the gas between the third chamber R3 and the inside of the communicating pipe 107, fluidically connectable between the first chamber R1 and the fourth chamber R4. The communicating pipe 107 is provided on its first chamber R1 side opening edge portion with the exhaust gas control valve, which opens and closes based on a pressure value of the exhaust gas.

In this muffler 100, most part of exhaust gas discharged from the engine is conducted through the inlet pipe 106 into the fourth chamber R4, where the gas expands to decrease its large energy. The gas in the fourth chamber R4 moves to the third chamber R3 through the holes 107*a* of the communicating pipe 107, where the holes 107*a* impose resistance to a flow of the gas so as to decrease its energy. On the other hand, the rest part of the gas in the inlet pipe 106 directly enters the third chamber R3 through the holes 106*a*, where they impose resistance to the flow of the gas so as to decrease its energy.

When engine is operated at low speed, the exhaust gas pressure is low in the fourth chamber R4, thereby the exhaust gas control valve 101 being closed. In this state, the first chamber R1 is fluidically separated from the second to fourth chambers R2 to R4. Accordingly, no exhaust gas enters the first chamber R1. In this condition, the gas in the third chamber R3 flows through the communicating hole 104*a* formed on the second partition wall 104 into the second chamber R2, and then out to the atmosphere only through the first outlet pipe 108. In this low engine speed operation, the muffler 100 decreases exhaust gas noise by using the fourth chamber R4 as a small chamber of a resonator.

On the other hand, when the engine is operated at high speed, the exhaust gas pressure is high in the fourth chamber R4, thereby the valve being opened. In this state, the first chamber R1 and the fourth chamber R4 are fluidically connected with each other through the communicating pipe 107, thereby forming a large chamber, since the pipe 107 has a large cross-sectional area. Correspondingly, the most part of the gas in the fourth chamber R4 flows into the first chamber R1 through the communicating pipe 107, and the rest of it flows into the third chamber R3 through the holes 107*a*. The former gas flows out from the first chamber R1 to the atmosphere through the second outlet pipe 109, and the latter gas flows out from the second chamber R2 to the atmosphere through the first outlet pipe 108. Therefore, the gas entering the muffler 100 is discharged from the first and second outlet pipe 108 and 109, which decreases flow resistance to the gas in the muffler 100, thereby suppressing the fall of engine output power in a high engine speed operation, where a driver wants large output power.

Referring to FIGS. 2A to 2C, 3, and 4, the exhaust gas control valve 101 consists of a valve seat 1 having a seat surface 12*a* at its inner side, a valve plate 2 rotatable around a shaft 3 for contacting its inner surface 20*a* with the seat surface 12, and a coil spring 4 for urging the valve plate 2 toward the seat surface 12*a*.

The valve seat 1 has a seat body portion 12 provided at its circumference with two side wall portions 13 and 13, a tip wall portion 14 and a guide portion 17.

The seat body portion 12 is shaped in a flat rectangle, and formed with a valve seat surface 12*a* at its inner side. The seat body portion 12 is integrally provided thereon at its central position with a pipe portion 11, which projects from an outer surface of the seat body portion 12 toward a pipe P (corresponding to the communicating pipe 107 in FIG. 1). The pipe portion 11 has a hole fittable to an opening edge portion of the pipe P, and is fixed on it.

The side wall portions 13 and 13 are arranged along sides of the seat body portion 12 respectively, projecting therefrom in a direction perpendicular to the seat body portion 12 and opposite to the pipe P. The side wall portions 13 and 13 bridge the tip wall portion 14 at their one ends, and increase their height from the one ends toward their other ends.

The supporting portions 13*a* and 13*a* are formed with a hole 13*b* for receiving the shaft 3 at their intermediate positions, and are joined with sides of the guide portion 17, respectively.

The guide portion 17 is integrally connected with the other ends of the seat body portion 12, and has a circular arc shape with an inner surface centered on the shaft 3.

On the other hand, the valve plate 2 includes a valve body portion 20 provided at its circumference with a tip wall portion 21, two side wall portions 22 and 22, and a guide wall portion 23.

The valve body portion 20 has a rectangular shape insertable within the side wall portions 13 and 13 and the tip wall portion 14 of the valve seat 1 so that its inner surface 20*a* can contact with the valve seat surface 12*a* of the seat body portion 12 so as to close an opening of the pipe portion 11 and move away from the seat surface 12*a* so as to open the opening. The inner surface 20*a* corresponds to a valve plate surface of the present invention.

The tip wall portion 21 and the side wall portions 22 and 22 project from the valve body portion 20 in a direction opposite to the pipe portion 11, and face the tip wall portion 14, two side wall portions 13 and 13, respectively, where the tip wall portion 21 is provided on the valve body portion 20 at its one end, and integrally connected at its both ends with the side wall portions 22 and 22 arranged along the both sides of the valve body portion 20. The side wall portions 22 and 22 have the supported portions 22*a* and 22*a*, which are arranged along and between the supporting portions 13*a* and 13*a* of the valve seat 1. The supported portions 22*a* and 22*a* are formed with a hole for receiving the shaft 3, and connected with both sides of the guide portion 23, respectively.

The guide portion 23 is formed continuously with the other end of the valve body portion 20 to have a circular arc shape with an inner surface centered on the shaft 3 The guide portion 23 has an inner surface formed along and facing an inner surface of the guide portion 17 of the valve seat 1, so that these surfaces can substantially prevent the exhaust gas from passing therethrough while the valve 101 opens and closes.

The shaft 3 supports the valve plate 2 rotatably relative to the valve seat 1 so as to open and close the valve 101.

The coil spring 4 consists of a coil portion 41, a valve seat side portion 42 and a valve plate side portion 43 for urging the inner surface 20*a* of the valve body portion 20 toward the valve seat surface 10*a* to close the valve 101. The coil portion 41 is wound around the shaft 3, the valve seat side portion 42 extends from the coil portion 41 and is fixed on an edge of the guide portion 17 of the valve seat 1, and the valve plate side portion 43 extends from the coil portion 41 and is fixed on the valve body portion 20 of the valve plate 2. This coil spring 4 is set so that its spring force can prevent opening of the valve 101 under exhaust gas pressure in the low engine speed operation.

The operation of the exhaust gas control valve 101 of the first embodiment will be described.

Figure 2A:
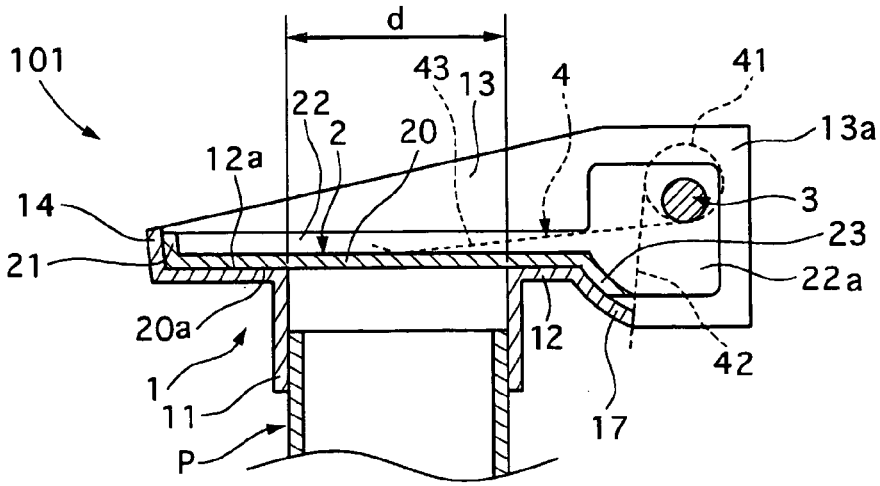
FIGS. 2A to 2C are cross-sectional side views showing the exhaust gas control valve shown in FIG. 1.

While the engine rests, no exhaust gas is generated, and accordingly the valve plate 2 is not pressed by the gas in an opening direction of the valve 101. In this state, press force by the coil spring 4 is applied to the valve plate 2 in a closed direction of the valve 101, so that their surfaces 20*a* and 10*a* contact with each other to close the valve 101, as shown in FIG. 2A.

When the engine starts, it discharges its exhaust gas into the muffler. The gas applies its pressure to a first exhaust gas pressure receiving area A1 on the inner surface 20*a* of the valve plate 2. The first exhaust gas pressure receiving area A1 corresponds to a cross area of the opening of the pipe portion 11, where the first exhaust gas pressure receiving area A1 is in a circular arc shape with a diameter of d shown in FIG. 2A.

During the low engine speed operation, the engine discharges a small amount of the exhaust gas, whose pressure is low and act only on the first exhaust gas pressure receiving area A1 smaller than a second exhaust gas pressure receiving area A2, which will be described later. Consequently, pressure force, obtained by multiplication of the exhaust gas pressure and the first exhaust gas pressure receiving area A1, acting on the valve plate 2 in the opening direction is so small that it can not move the valve plate 2 away from the valve seat 1 by overcoming the spring force of the coil spring 4. Therefore, the inner surface 20*a* of the valve body portion 20 is kept in contact with the valve seat surface 10*a*, thereby the valve 101 being kept in a closed state, as shown in FIG. 2A, where the first chamber R1 is in no communication with the second and fourth chambers R2 and R4.

In this closed state, a larger chamber is not formed in the muffler 100, thus only plural small chambers being formed in the muffler 100 by the second to fourth chambers R2 to R4, and the fourth chamber R4 acting as a resonant chamber. Therefore, its exhaust gas noise is efficiently decreased prior to reduction in its back pressure.

When the engine speed becomes higher, its exhaust gas amount increases, and accordingly the exhausts gas pressure becomes higher to generate larger pressure force. This larger pressure force generated in a middle engine speed operation is applied to the first exhaust gas pressure receiving area A1 of the valve plate 2, thereby rotating the valve plate 2 around the shaft 3 in the opening direction when the pressure force overcomes the spring force of the coil spring 4. This rotating movement of the valve plate 2 causes its inner surface 20*a* to move away from the valve seat surface 10*a* of the valve seat 1, so that the pressurized gas starts to apply its larger pressure force to the second exhaust gas pressure receiving area A2 including the first exhaust gas pressure receiving area A1. The second exhaust gas pressure receiving area A2 corresponds to a rectangular area, which is an area of the inner surface 20*a* of the valve body portion 20.

The valve 101 is kept closed at this intermediate stage although the valve plate 2 is rotated from a position in the closed position, since overlaps, between the tip wall portion 14 of the valve seat 1 and the tip portion 21 of the valve plate 2 and between the side wall portions 13 and 24 of them, substantially shut a communicating passage through the communicating pipe 107 between the first chamber R1 and the other chambers.

Figure 2B:
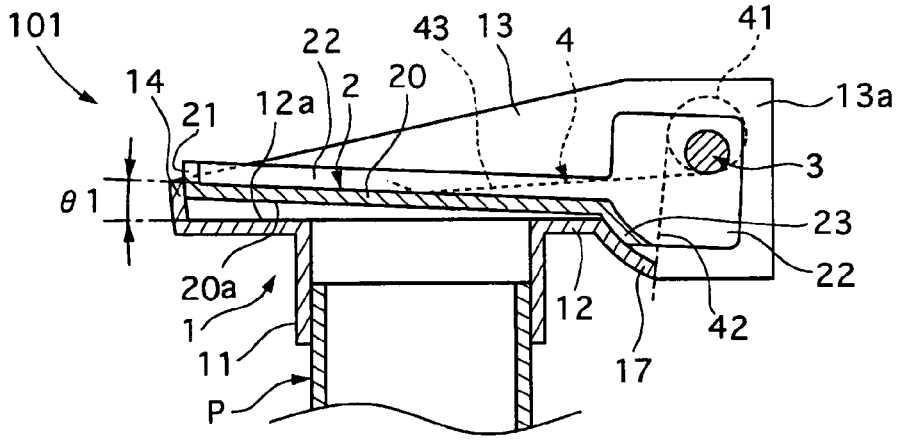
Figure 2C:
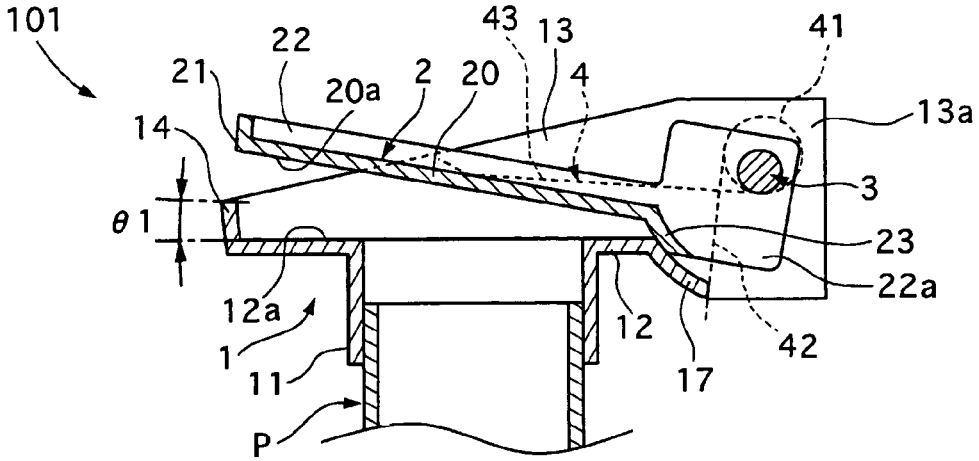
Figure 3:
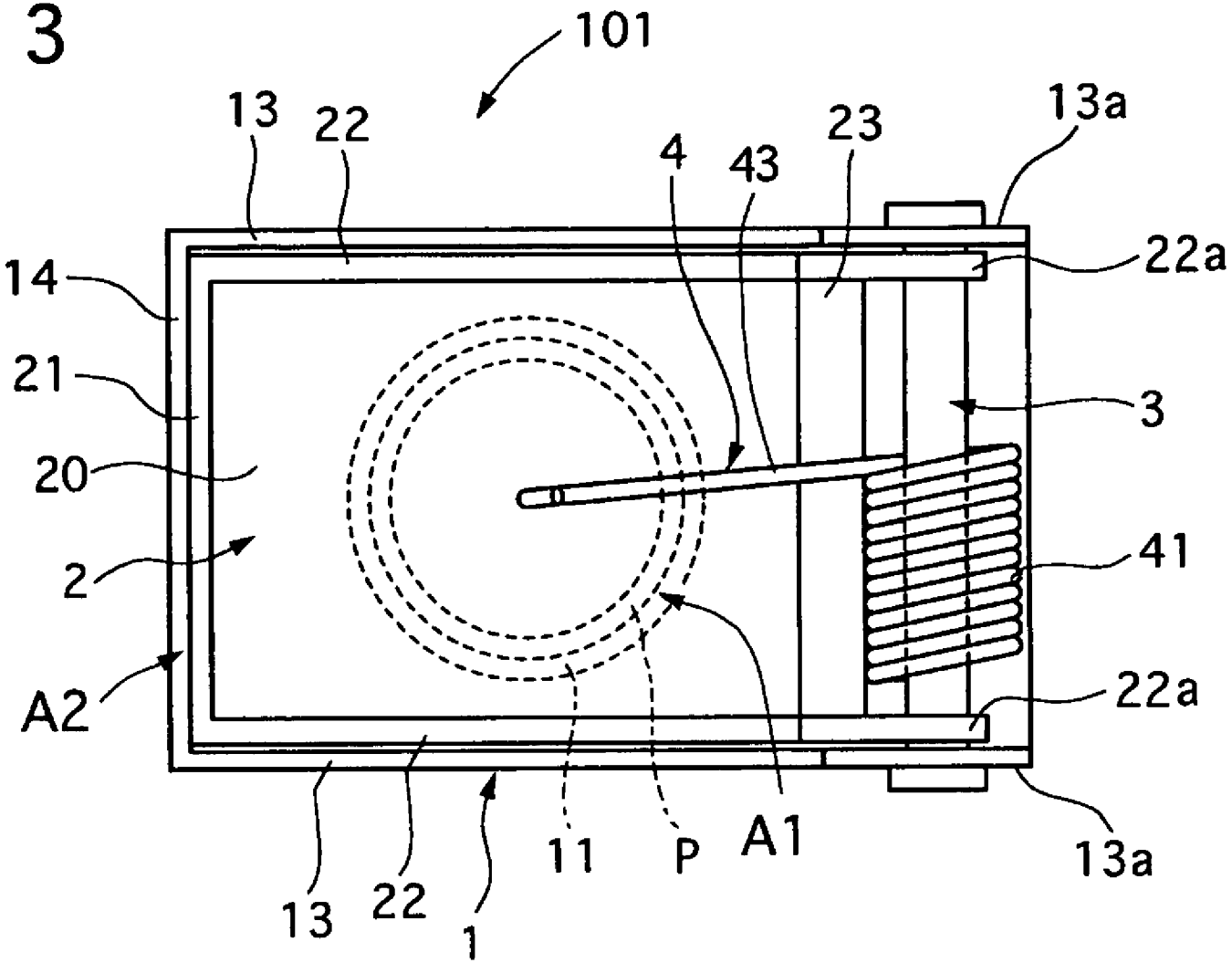
FIG. 3 is a plan view showing the exhaust gas control valve shown in FIGS. 1, and 2A to 2C.
Figure 4:
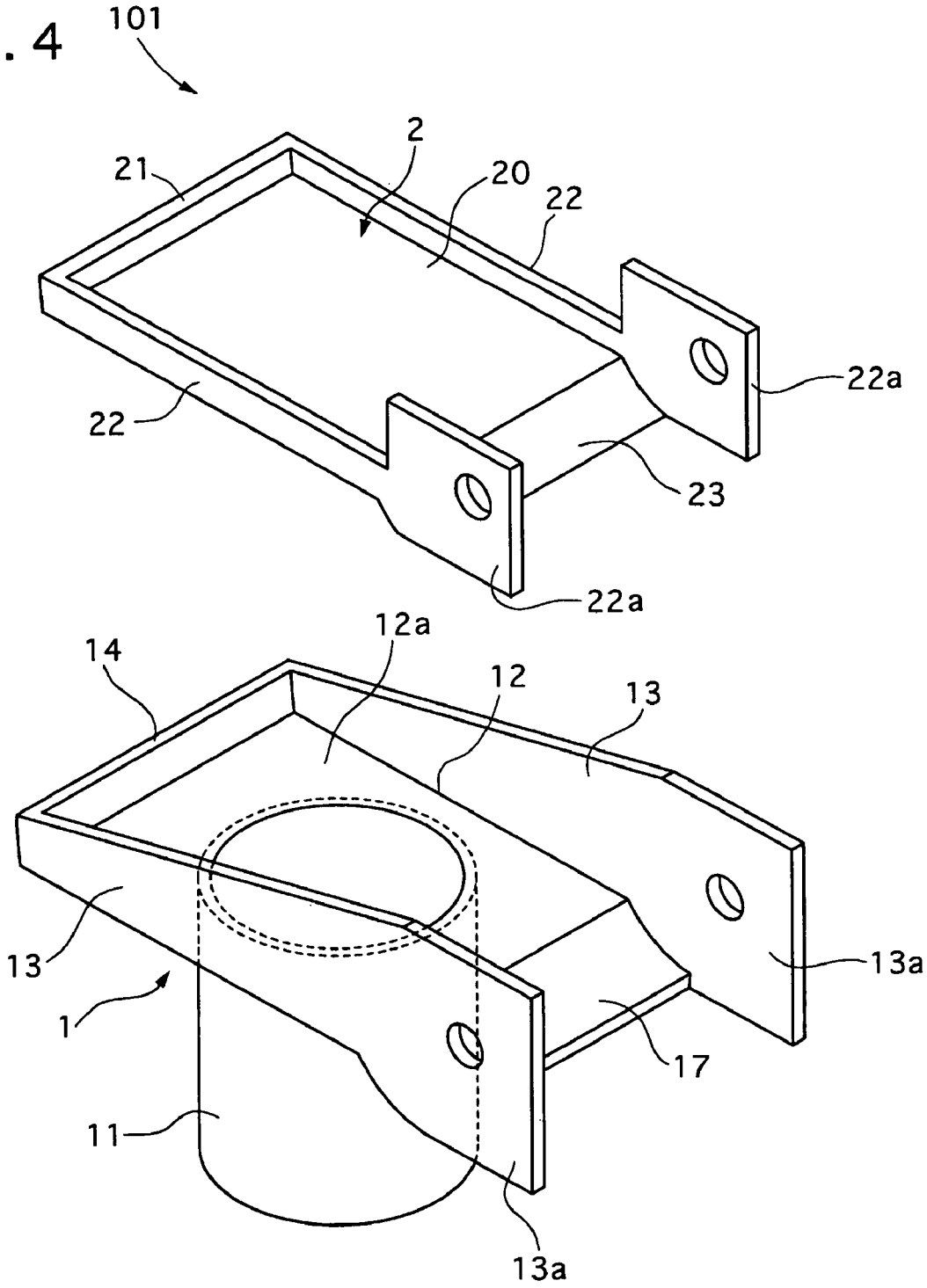
FIG. 4 is an enlarged and exploded perspective view showing the control valve shown in FIGS. 1, 2A to 2C, and 3.

This overlapping range is indicated by an angle range θ1 as shown in FIG. 2B, where the inner surface 20*a* of the valve plate 2 is apart from the valve seat surface 12*a*, keeping the valve 101 to be in the closed state, but the gas pressure starts to act on the second exhaust gas pressure receiving area A2. Note that FIG. 2B shows a state that the valve plate 2 is positioned a little short of the upper limit angle of the angle range θ1, which is determined by an angle at a shifting position where a tip of the inner surface 20*a* comes to a tip edge of the tip wall portion 14. The overlapping state in the angle range θ1 corresponds to the intermediate stage of the valve 101.

In the intermediate stage state, the valve plate 2 is pressed in the opening direction by the exhaust gas pressure acting on the second exhaust gas pressure receiving area A2 which is larger than the first exhaust gas pressure receiving area A1. Accordingly, its pressure force becomes larger according to an area ratio between them, and easily opens the valve 101 by further moving the valve plate 2 away from the valve seat 1 to communicate the fourth chamber R4 with the first chamber R1 through the communicating pipe 107 as shown in FIG. 4C. In this opening state of the valve 101 where an angle between the valve seat 1 and the valve plate 2 is more than θ1, the tip wall portion 14 of the valve seat 1 and the tip portion 21 of the valve plate 2 are separated from each other to form a gap between them, and the side wall portions 13 and 24 are partially separated from each other to form a gap between them, so that their gaps function as an exhaust gas passage communicating the fourth chamber R4 to the first chamber R1.

In this opening state, the flow resistance to the gas is reduced by adding a new exhaust gas passage formed by the first chamber R1 and the second outlet pipe 109 to an exhaust gas passage formed by the second chamber R2 and the first outlet pipe 108 in the low engine speed operation, which can suppress the fall of the engine output power in the high engine speed operation. After the opening of the valve 101, the valve 101 is kept to be in the opening state as long as the gas pressure is higher than a certain pressure, which is determined by the second exhaust gas pressure receiving area A2 and spring force of the coil spring 41. Accordingly, this certain pressure becomes lower than pressure for overcoming the spring force to shift the valve 101 from the closed state to the intermediate state.

The exhaust control valve 101 of the first embodiment has the following advantages.

The valve 101 can decrease the exhaust noise in the low engine speed operation, and suppress the fall of the engine output power by lessening the back pressure caused by the muffler 100 in the high engine speed operation.

The valve 101 can avoid leakage of the exhaust gas from a gap between the guide portion 17 and the valve seat 1 and the guide portion 23 of the valve plate 2 both in the closed state and in the opening state, providing sufficient reduction in the back pressure for suppressing the fall of the engine output power by enlargement of the exhaust gas pressure receiving area of the valve plate 2 during the high engine speed operation.

The coil spring 41 of the valve 101 is not exposed to the hot exhaust gas directly outputted from the gap between the guide portions 17 and 23, because the gap is so small that substantially no gas can pass therethrough. This enhances permanent set-in fatigue resistance of the spring 41.

Next, an exhaust gas control valve of a second embodiment according to the present invention will be described with reference to the drawings of FIGS. 5A to 7.

This control valve 101 is constructed so that it can change angles between a valve seat 1 and a valve plate 2 to shift the valve 101 among in a closed state, in an intermediate state, in a second opening state, and in a third opening state, where the angle becomes larger in these order. These states will be described later.

The valve seat 1 comprises a first seat body portion 10, a second seat body portion 15, a tip wall portion 14, two side wall portions 13 and 13 with supporting portions 13*a* and 13*a*, a connecting wall portion 16, and a guide portion 17.

The first seat body portion 10 is shaped in a flat rectangle, and formed with a first valve seat surface 10*a* at its inner side. The first seat body portion 10 is integrally provided thereon at its central portion with a pipe portion 11, which projects from an outer surface of the first seat body portion 10 toward a pipe P (corresponding to the communicating pipe 107 in FIG. 1). The pipe portion 11 has a hole fittable to an opening edge portion of the pipe P. The first seat body portion 10 is integrally connected with the second seat body portion 15 through the connecting wall portion 16 at its one end portion, and also with the guide portion 17 at its other end portion.

The second seat body portion 15 projects forward from the connecting wall portion 16 in a state where the second seat body portion 15 is located apart from the first seat body portion 10 in an opening direction opposite to the pipe portion 11. The second seat body portion 15 is shaped in a flat rectangle to have a second valve seat surface 15*a*, which is smaller in area than the first valve seat surface 12, at its inner side.

The tip wall portion 14 projects from a tip of the second seat body portion 15 in the opening direction, and is integrally connected with the side wall portions 13 and 13 at its both ends.

The side wall portions 13 and 13 project from both sides of the first an second seat body portions 10 and 15 in the first direction and has supporting wall portions 13*a* and 13*a*, respectively. The supporting wall portions 13*a* and 13*a* are formed with a hole for receiving a shaft 3 and integrally joined to the guide portions 13*a* and 13*a*.

The guide portion 17 is formed to have a circular arc shape with an inner surface centered on the shaft 3.

On the other hand, the valve plate 2 comprises a first valve body portion 21, a second valve body portion 25, the connecting wall portion 24, a tip wall portion 26, two side wall portions 22 and 22 with supported portions 22*a* and 22*a*, and a guide portion 23.

The first valve body portion 21 is shaped in a flat rectangle, which is insertable within the side wall portions 13 and 13 and the connecting wall portion 16 of the valve seat 1 so that its first inner surface 21*a* can contact with the first valve seat surface 10*a* of the valve seat 1 so as to close an opening of the pipe portion 11 and move away from the first seat surface 10*a* so as to open the opening.

The second first valve body portion 25 is shaped in a flat rectangle to have a second inner surface 25*a*, which is smaller in area than the first inner surface 21*a*. It is insertable within the side wall portions 13 and 13 and the tip portion 14 of the valve seat 1 so that the second inner surface 25*a* can contact with the second inner surface 15*a* of the valve seat 1 so as to close the valve 101 and move away from the second inner surface 15*a* so as to open the valve 101.

The first inner surface 21*a* and the second inner surface 25*a* correspond to a valve plate surface of the present invention.

The tip portions 14 and 21 and the connecting portions 16 and 24 are constructed so that the tip portions 14 and 21 are overlapped when the connecting portions 16 and 24 are apart from each other to form a gap between them.

The other parts of the valve 101 is constructed similarly to those of the first embodiment.

The operation of the exhaust gas control valve 101 of the second embodiment will be described.

When an engine rests, the operation of the valve 101 is in a closed state similarly to that of the first embodiment.

During a low engine speed operation, its exhaust gas pressure applies its pressure force to a first exhaust gas pressure receiving area A1 corresponding to an area of the opening of the pipe portion 11. The inner first surfaces 10*a* and 21*a* are kept in contact with each other to close the opening, because the gas pressure is low.

In this closed state, only plural small chambers are formed in a muffler by chambers, and at least one of the chambers acts as a resonant chamber, efficiently decreasing exhaust gas noise.

When the gas pressure increases, the pressure generated in a middle engine speed operation applies stronger pressure force to the valve plate 2 to move away from the first inner surface 10*a* of the valve seat 1 in the opening direction. This movement of the valve plate 2 causes an exhaust gas pressure receiving area to shift from the first exhaust gas pressure receiving area A1 to a second exhaust gas pressure receiving area A2 corresponding to an area of the first inner surface 21*a*.

Therefore, the pressure fore acting on the valve plate 2 in the opening direction increases due to enlargement of its exhaust gas pressure receiving area. This enlarged area is limited to the second exhaust gas pressure receiving area A2, since the connecting wall portion 24 of the valve plate 2 overlaps with the connecting wall portion 16 of the valve seat 1 although the opening of the pipe portion 11 is opened. This state corresponds to an intermediate stage, and this overlapping range of the connecting wall portions 16 and 24 is indicated by an first angle range θ1 as shown in FIG. 5B.

Figure 5A:
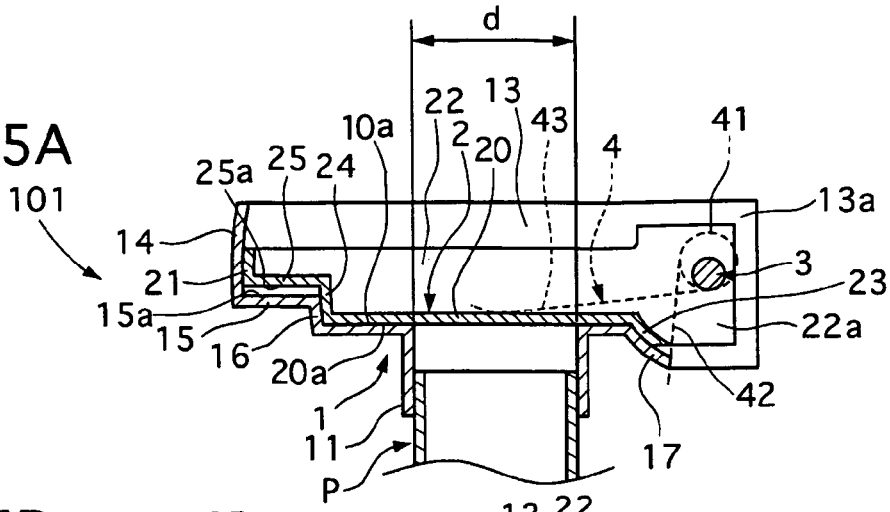
FIGS. 5A to 5D are cross-sectional side views showing an exhaust gas control valve of a second embodiment according to the present invention.
Figure 5B:
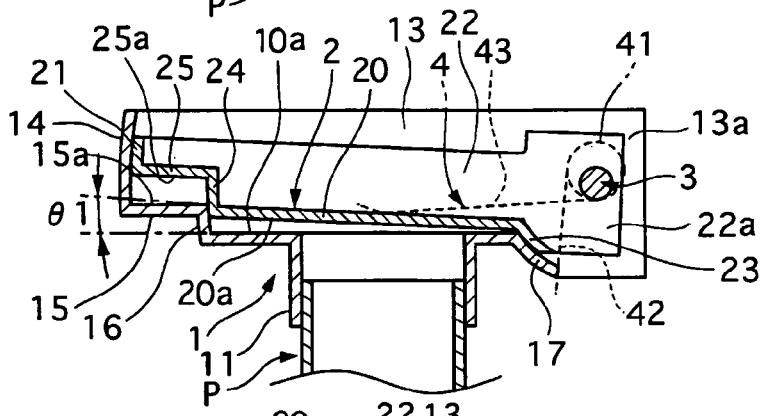

Note that FIG. 5B shows a state that the valve plate 2 is positioned a little short of the upper limit angle of the first angle range θ1, which is determined by an angle at a shifting position where a tip edge of the first inner surface 21*a* comes to a tip edge of the connecting wall portion 16. A value of the first angle range θ1 is ordinarily set to be smaller than that of the angle range θ1 of the first embodiment.

Then, when the gas pressure, acting on the first exhaust gas pressure receiving area A1, overcomes spring force of a coil spring 4 and moves the tip edge of the inner surface 21*a* away from the tip edge of the connecting wall portion 16 of the valve seat 1 in the opening direction, the gas flows into a space between the second inner surface 15*a* of the valve seat 1 and the second inner surface 25*a* of the valve plate 2. This further movement shifts the exhaust gas pressure receiving area from the second exhaust gas pressure receiving area A2 to a third exhaust gas pressure receiving area A3 which is obtained by adding an area of the second inner surface 25*a* to the second exhaust gas pressure receiving area A2.

Therefore, the pressure fore acting on the valve plate 2 in the opening direction increases more due to enlargement of its exhaust gas pressure receiving area. This enlarged area is limited to the third exhaust gas pressure receiving area A3, since the tip wall portion of the valve plate 2 overlaps with the tip wall portion 14 of the valve seat 1. This state corresponds to a second stage, and this overlapping range of the connecting wall portions 16 and 24 is indicated by an second angle range θ2 as shown in FIG. 5C.

Figure 5C:
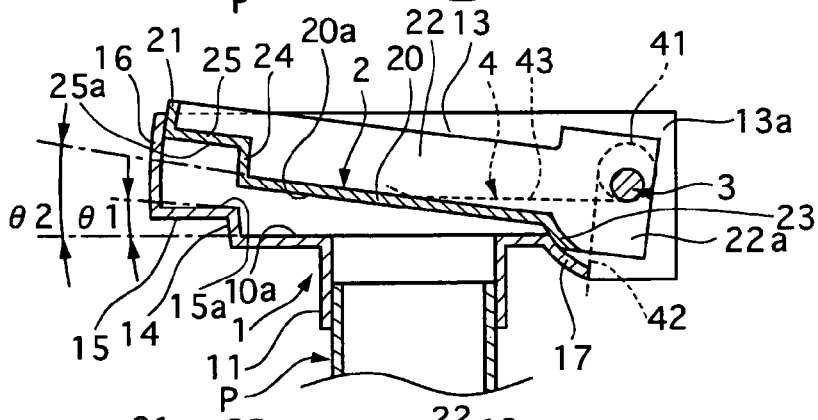

Note that FIG. 5C shows a state that the valve plate 2 is positioned a little short of the upper limit angle of the second angle range θ2, which is determined by an angle at a shifting position where a tip edge of the second inner surface 25*a* comes to a tip edge of the tip wall portion 14. A value of the first angle range θ2 may be set to be the same as that of the angle range θ1 of the first embodiment for example, but may be different.

Figure 5D:
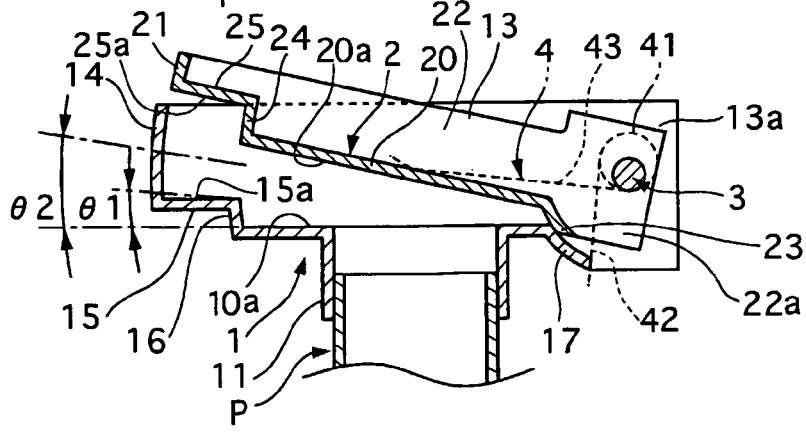
Figure 6:
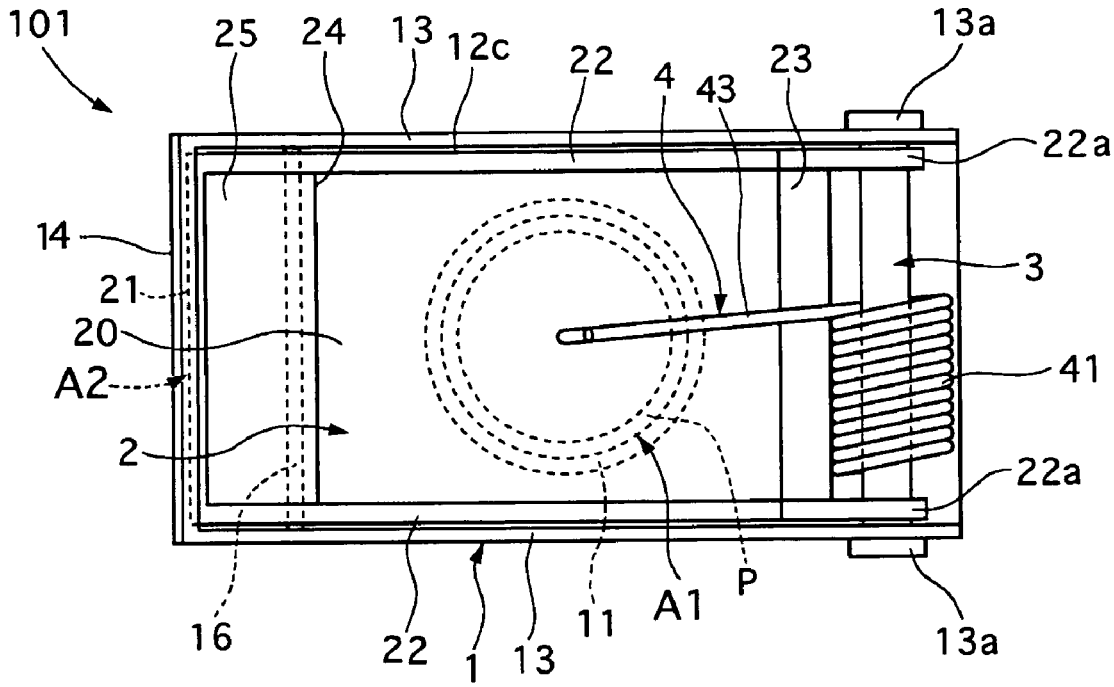
FIG. 6 is a plan view showing the exhaust gas control valve shown in FIGS. 5A to 5D.
Figure 7:
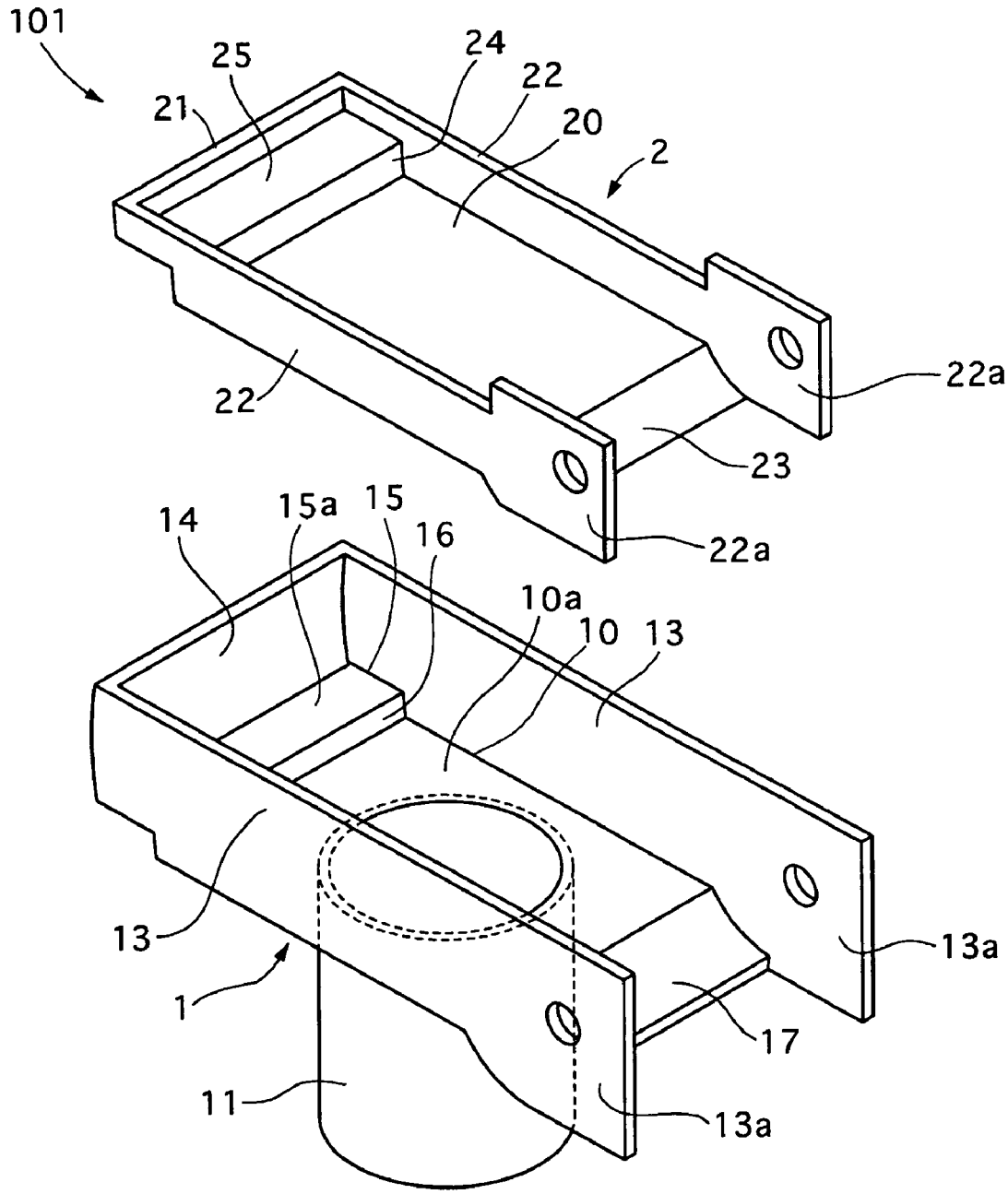
FIG. 7 is an enlarged and exploded perspective view showing the control valve shown in FIGS. 5A to 5D and 6.

In a high engine speed operation, the exhaust gas pressure becomes large enough to overcome the spring force and open the valve 101 as shown in FIG. 5D. In this opening state, the flow resistance to the gas is reduced, accordingly back pressure being decreased for suppressing fall of engine output power.

The exhaust gas control valve 101 of the second has the following advantages in addition to those of the first embodiment.

In the valve, the exhaust gas pressure receiving area is shifted to increase its area gradually through two stages (stages of the intermediate state and the second opening state) before it opens, which can suppress unstable fluctuation of gas pressure due to sudden enlargement of the exhaust gas pressure receiving area.

Next, an exhaust gas control valve of a third embodiment according to the present invention will be described with reference to the drawings of FIG. 8A to 9.

The control valve 101 of the second embodiment comprises a valve seat 1 and a valve plate 2 movable according to exhaust gas pressure relative to the valve seat 1. The valve 101 is mounted on a baffle plate 5, which is used for defining an inner space of a muffler into plural chambers. For example, this baffle plate 5 corresponds to the first partition wall 103 of the first embodiment shown in FIG. 1.

The baffle plate 5 is formed with a pipe portion 11 projecting from its one side surface and fitted to a pipe P (corresponding to the communicating pipe 107 of the first embodiment). The plate 5 is also formed with a projection 5*a* extending along a shaft 3 on its other side surface.

The valve seat 1 includes the projection 5*a* of the baffle plate 5, a tip wall portion 14, two side wall portions 13 and 13 with supporting portions 13*a* and 13*a*, and a part of the baffle plate 5 corresponding to an area surrounded by the wall portions 14 and 13 and the projection 5*a*. The other side surface of the surrounded area acts as a seat surface 5*b*. The tip wall portion 14 is integrally connected with the side wall portions 13 and 13 at its both ends, respectively. The part of the baffle plate 5 corresponding to an area surrounded by the wall portions 14 and 13 and the projection 5*a* corresponds to a seat body portion of the present invention.

The valve plate 2 has a valve body portion 20 provided at its circumference with a tip wall portion 21, two side wall portions 22 and 22 with supported portions 22*a* and 22*a* and a guide portion 23.

The valve body portion 20 is basically shaped in a flat rectangle, and rotatable around the shaft 3. The tip wall portion 21 and the side wall portions 22 and 22 of the valve plate 2 are respectively arranged along and face the tip wall portion 14 and the side wall portions 13 and 13 of the valve seat 1 so that they can prevent substantial leakage of exhaust gas from gaps formed therebetween in a closed state of the valve 101.

The guide portion 23 is formed to have a circular arc shape with an inner surface centered on the shaft 3. An inner surface of the guide portion 23 is set to contact with the projection 5*a* of the baffle plate 5 during an operation of the valve 101 from the closed state to an opening state so as to prevent leakage of the exhaust gas therebetween.

An area of the valve plate 2 corresponding to the opening of the pipe portion 11 corresponds to a first exhaust gas pressure receiving area A1, and an inner area of the valve body portion 20 and an inner area of the guide portion 23 defined by the valve body portion 20 and the projection 5*a* correspond to a second exhaust gas pressure receiving area A2. An inner surface of the second exhaust gas pressure receiving area A2 corresponds to a valve plate surface of the present invention.

The other parts are constructed similarly to those of the first embodiment.

The operation of the exhaust gas control valve 101 of the third will be described. The operation of the valve 101 is similar to that of the exhaust gas control valve of the first embodiment.

Figure 8A:
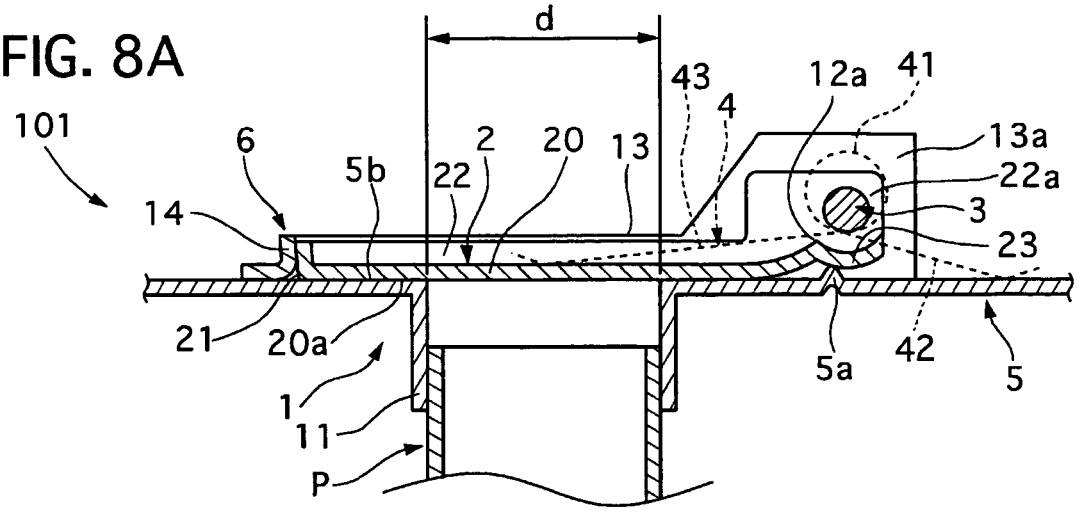
FIGS. 8A to 8C are cross-sectional side views showing an exhaust gas control valve of a third embodiment according to the present invention.
Figure 8B:
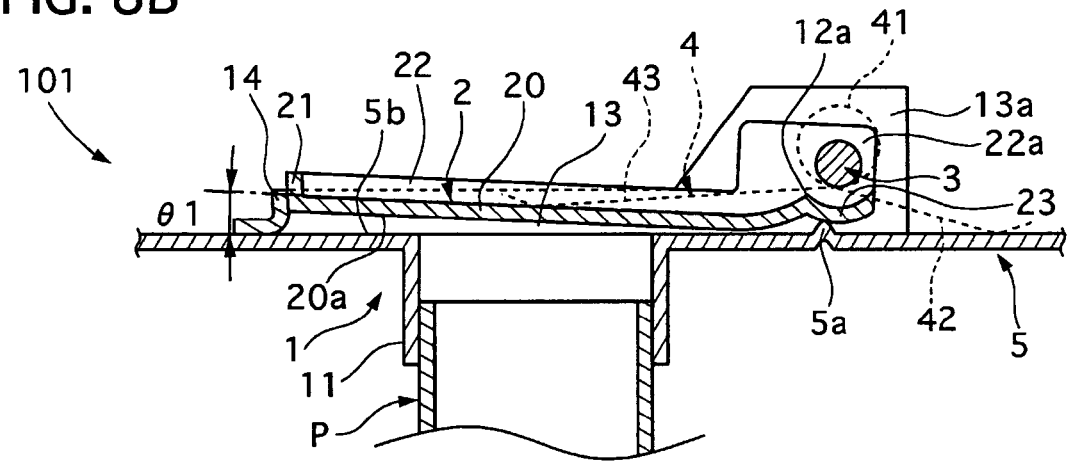
Figure 8C:
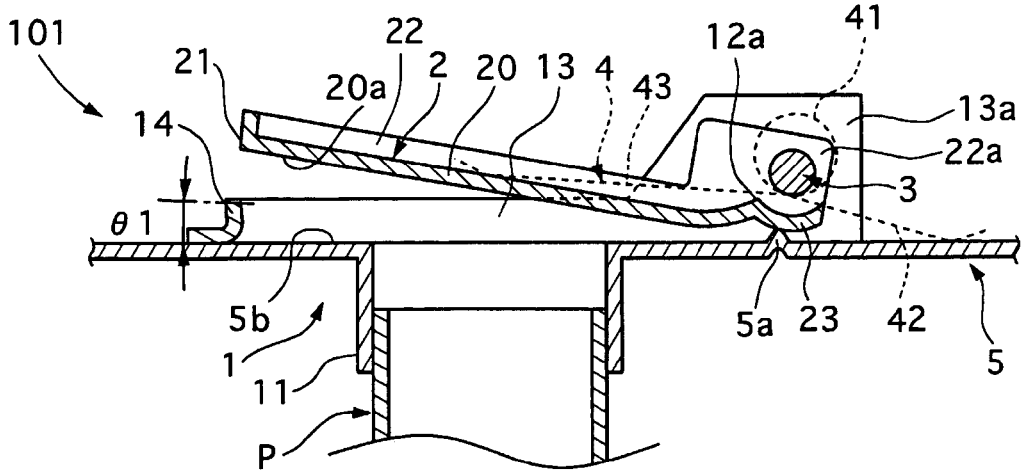
Figure 9:
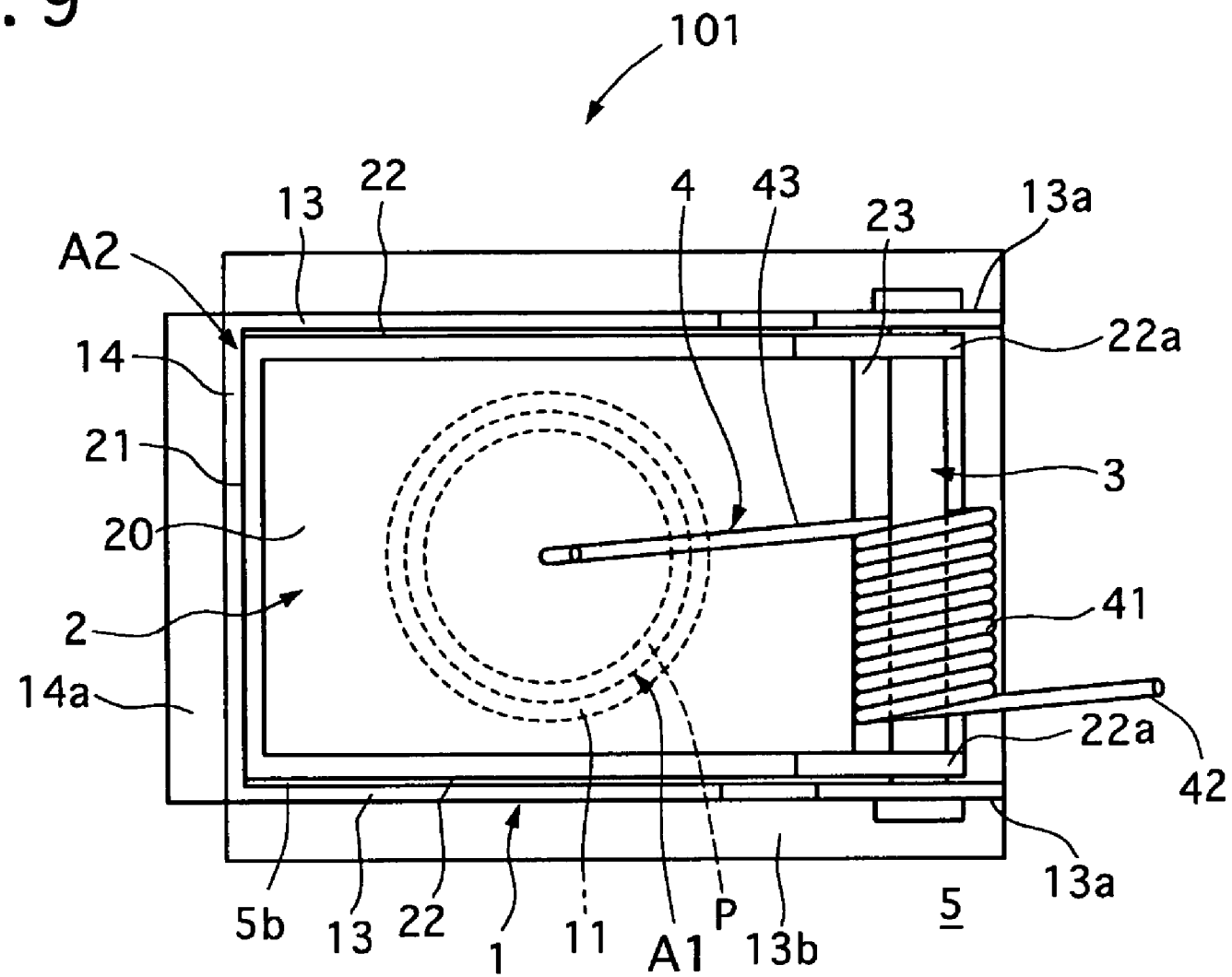
FIG. 9 is a plan view showing the exhaust gas control valve shown in FIGS. 8A to 8C.

When an engine is operated at low speed, the valve 101 is in the closed state, shown in FIG. 8A, where the inner face of the valve plate 2 and with the valve seat surface 5*b* contact with each other to shut the opening of the pipe portion 11. Therefore, a large chamber is not formed, and plural small chambers decrease its exhaust noise effectively.

When exhaust gas pressure increases, the valve becomes to be in an intermediate state, where the valve 101 opens the opening of the pipe portion 11 but the tip portions 14 and 21 are in contact with each other. Therefore, an exhaust gas pressure receiving area of the valve 101 is enlarged to be opened more easily in this middle engine speed operation.

When the engine is operated at high speed, high exhaust gas pressure acts on the second exhausts gas pressure receiving area A2 and open the valve 101 to establish another exhaust gas passage between rooms in the muffler through the pipe P and the valve 101. Therefore, the large room connecting to another outlet pipe for discharging the gas to the atmosphere is formed, decreasing back pressure so as to suppress fall of engine output power.

The exhaust gas control valve 101 of the third has the following advantages in addition to those of the first embodiment.

The valve 101 of the third embodiment can decrease its manufacturing cost and weight, since the seat body portion 12 and guide portion 17 of the first embodiment are removed.

While there have been particularly shown and described with reference to preferred embodiments thereof, it will be understood that various modifications may be made therein, and it is intended to cover in the appended claims all such modifications as fall within the true spirit and scope of the invention.

For example, the control valve 101 of the second embodiment is set to have two stages for enlarging its exhaust gas pressure receiving area, from the first exhaust gas pressure receiving area A1 to the second exhaust gas pressure receiving area A2, but an exhaust gas control valve of the present invention may be set to have more-than-two stages where its exhaust gas pressure receiving area is gradually enlarged.

A valve seat surface of the valve seat 1 and an inner surface of the valve plate of the present invention may be formed arbitrarily as long as they can prevent leakage of exhaust gas therebetween, in a tapered shape for example.

A coil spring of the present invention may be supported on another part, not on the shaft 3 like the embodiment.

An exhaust control valve constructed above may be provided on either a baffle plate or a pipe of a muffler in the present invention.

The entire contents of Japanese Patent Applications No. 2004-027149 filed Feb. 3, 2004 and No. 2005-005700 filed Jan. 12, 2005 are incorporated herein by reference.

What is claimed is:

1. An exhaust gas control valve which shifts exhaust gas passages connectable between plural rooms in a muffler according to engine speed, the exhaust gas control valve comprising:

a valve seat formed with a valve seat surface and provided with a wall portion projecting from the valve seat surface, the valve seat having an opening to pass exhaust gas through the valve seat;

a valve plate formed with a valve plate surface and provided with a wall portion arranged along the wall portion of the valve seat, the valve plate surface having a first exhaust gas pressure receiving area which corresponds to an area of the opening and is contactable with the valve seat surface so that the exhaust gas control valve can prevent leakage of the exhaust gas through the opening and a second exhaust gas pressure receiving area which is larger than the first exhaust gas pressure receiving area; and a spring pressing the valve plate toward the valve seat, and wherein the exhaust valve is shiftable among at least a closed state where pressure of the exhaust gas generated in a low engine speed operation acts on only the first exhaust gas pressure receiving area and the first exhaust gas pressure receiving area is in contact with the valve seat surface to shut the opening, an intermediate state where the pressure generated in a middle engine speed operation acts on the first exhaust gas pressure receiving area and the second exhaust gas pressure receiving area and the valve plate surface is apart from the valve seat surface to open the opening while the wall portions of the valve plate and the valve seat overlap with each other to keep the exhaust gas control valve closed, and an opening state where the pressure generated in a high engine speed operation acts on the first exhaust gas pressure receiving area and the second exhaust gas pressure receiving area and at least a part of the wall portions are apart from each other to form a gap through which the exhaust gas can pass, wherein the valve seat has a seat body portion having the valve seat surface, a tip wall portion projecting from a tip end of the seat body portion, and side wall portions projecting from side edges of the seat body portion and contacting both ends of the tip wall portion, and the valve plate has a valve body portion having the valve plate surface, a tip portion and side wall portions which are arranged along the tip portion and the side wall portions of the valve seat and insertable within an area surrounded by the tip portion and the side wall portions of the valve seat.

wherein the valve plate is rotatable around a shaft relative to the valve seat, and wherein a shaft side portion of the seat body portion and a shaft side portion of the valve body portion have guide portions with circular-arc shaped inner surfaces centered on the shaft and facing with each other for preventing a leakage of the exhaust gas therebetween.

2. The exhaust gas control valve of claim 1, wherein the shaft is located over the guide portions and supports the spring.

3. The exhaust gas control valve of claim 2, wherein the valve seat surface and the valve plate surface are formed in a flat rectangular shape.

4. The exhaust gas control valve of claim 3, wherein the exhaust gas control valve is fixed to one of a pipe and a baffle plate of the muffler such that the exhaust gas control valve can prevent and allow a flow of the exhaust gas therethrough.

5. The exhaust gas control valve of claim 1, wherein the valve plate surface has more than one exhaust gas pressure receiving area which becomes larger in area as the valve plate moves further away from the valve seat in the intermediate state.

6. The exhaust gas control valve of claim 5, wherein the valve plate is rotatable around the shaft relative to the valve seat, and wherein the valve seat has seat body portions in a stepped shape which project in turn in a direction opposite to the shaft and higher in turn in a direction away from the opening, and the valve plate has valve body portions in a stepped shape fittable to the seat body portions.

7. The exhaust gas control valve of claim 5, wherein the valve seat surface and the valve plate surface are formed in a flat rectangular shape.

8. The exhaust gas control valve of claim 1, wherein the exhaust gas control valve is fixed to one of a pipe and a baffle plate of the muffler such that the exhaust gas control valve can prevent and allow a flow of the exhaust gas therethrough.

9. The exhaust gas control valve of claim 2, wherein the exhaust gas control valve is fixed to one of a pipe and a baffle plate of the muffler such that the exhaust gas control valve can prevent and allow a flow of the exhaust gas therethrough.

10. The exhaust gas control valve of claim 1, wherein the valve seat surface and the valve plate surface are formed in a flat rectangular shape.

11. The exhaust gas control valve of claim 10, wherein the exhaust gas control valve is fixed to one of a pipe and a baffle plate of the muffler such that the exhaust gas control valve can prevent and allow a flow of the exhaust gas therethrough.

12. The exhaust gas control valve of claim 6, wherein the exhaust gas control valve is fixed to one of a pipe and a baffle plate of the muffler such that the exhaust gas control valve can prevent and allow a flow of the exhaust gas therethrough.

13. The exhaust gas control valve of claim 7, wherein the exhaust gas control valve is fixed to one of a pipe and a baffle plate of the muffler such that the exhaust gas control valve can prevent and allow a flow of the exhaust gas therethrough.

* * * * *